US006751878B2

(12) United States Patent
Hamann

(10) Patent No.: US 6,751,878 B2
(45) Date of Patent: Jun. 22, 2004

(54) APPARATUS AND METHOD FOR CREATING A DRAWING OF A THREE-DIMENSIONAL OBJECT MANUALLY AND /OR ELECTRONICALLY BY VIEWING THE OBJECT THROUGH A TRANSPARENT WINDOW PANE AND TRACING THE OBJECT ON THE TRANSPARENT WINDOW PANE

(76) Inventor: David Hamann, 4248 Kirby Ave., Cincinnati, OH (US) 45223

( * ) Notice: Subject to any disclaimer, the term of this patent is extended or adjusted under 35 U.S.C. 154(b) by 0 days.

(21) Appl. No.: 10/094,371

(22) Filed: Mar. 8, 2002

(65) Prior Publication Data

US 2002/0124422 A1 Sep. 12, 2002

Related U.S. Application Data

(60) Provisional application No. 60/274,032, filed on Mar. 8, 2001.

(51) Int. Cl.[7] ..... B43L 13/14

(52) U.S. Cl. ..... 33/18.3; 33/1 K; 33/432; 248/461; 248/441.1

(58) Field of Search ..... 33/1 K, 18.3, 23.01, 33/23.08, 18.1, 20.1, 20.3, 27.12, 430, 432, 562, 563, 566; 434/86–88; 248/461, 441.1, 460, 447

(56) References Cited

U.S. PATENT DOCUMENTS

| | | | | | |
|---|---|---|---|---|---|
| 2,410,447 | A | * | 11/1946 | Juran | 434/91 |
| 2,418,286 | A | * | 4/1947 | Austin | 434/85 |
| 3,061,948 | A | * | 11/1962 | Stubbmann | 434/410 |
| 4,168,573 | A | * | 9/1979 | Chase | 33/1 K |
| 4,432,140 | A | * | 2/1984 | Santamaria Ulecia | 33/20.3 |
| 4,498,238 | A | * | 2/1985 | Vaughn | 33/1 K |
| 4,604,062 | A | * | 8/1986 | Woods | 434/88 |
| 4,966,815 | A | * | 10/1990 | Hare | 428/497 |
| 5,035,393 | A | * | 7/1991 | Menaged | 248/456 |
| 5,088,814 | A | * | 2/1992 | Campbell | 353/44 |
| 5,203,702 | A | * | 4/1993 | Wilson | 434/85 |
| 5,508,720 | A | * | 4/1996 | DiSanto et al. | 345/169 |
| 5,708,458 | A | * | 1/1998 | Vrbanac | 345/156 |
| 5,724,064 | A | * | 3/1998 | Stefik et al. | 345/105 |
| 6,045,108 | A | * | 4/2000 | Cziraky | 248/454 |
| 6,092,294 | A | * | 7/2000 | Mak | 33/18.1 |
| 6,154,968 | A | * | 12/2000 | Andre | 33/1 K |
| 6,164,976 | A | * | 12/2000 | Wilson | 434/414 |
| 6,380,929 | B1 | * | 4/2002 | Platt | 345/173 |
| 6,540,192 | B2 | * | 4/2003 | Ouellet | 248/461 |
| 2003/0029985 | A1 | * | 2/2003 | Zeller et al. | 248/461 |

OTHER PUBLICATIONS

Web pages from Zany Brainy online shopping center website, printed Jan. 9, 2003, copyright 2000, pp. 1–2.*
Web pages from Crayola online shopping center website, printed Jan. 13, 2003, pp. 1–2.*

* cited by examiner

*Primary Examiner*—Christopher W. Fulton
*Assistant Examiner*—Amy R. Cohen

(57) ABSTRACT

A tracing an object has front and rear shells that are pivoted to each other to form a case. The rear shell defines a platform for supporting an object and the front defines a clear window pane forming a tracing plane through which the object is visible. A leg connected between the shells supports the front shell at an open position. A support movably mounted to the front shell carries a view port to view the object through the window pane and to trace an image of the object on the tracing plane.

15 Claims, 6 Drawing Sheets

APPARATUS AND METHOD FOR CREATING A DRAWING OF A THREE-DIMENSIONAL OBJECT MANUALLY AND /OR ELECTRONICALLY BY VIEWING THE OBJECT THROUGH A TRANSPARENT WINDOW PANE AND TRACING THE OBJECT ON THE TRANSPARENT WINDOW PANE

CROSS-REFERENCE TO RELATED APPLICATION

This application claims priority from provisional application Ser. No. 60/274,032 filed Mar. 8, 2001.

BACKGROUND OF THE INVENTION

This invention relates to the field of art, and specifically to a device for use In the drawing of three-dimensional objects.

Drawing, painting and coloring are artful endeavors. They are fun-time activities and hobbles for adults and children. A high degree of pleasure and satisfaction can be gained by a person using his own hands and eyes to create a drawing, painting or coloring of an object recalled from memory, an imaginary object or an object that he sees before him.

Drawing, painting and coloring skills are useful to many types of students and professionals In the course of doing projects or jobs. Artists, designers, illustrators, architects and the like create drawings, paintings and colorings to develop and to convey concepts and designs; to one another, to customers and to the public.

The basis for many artistic creations lies in the development of an accurate drawing of a three-dimensional object. Such drawings are desirable for hobbyists, artists, craftsmen and other professionals as finished works or as templates and tools for creating more refined works.

A person can use pencils, pens, markers, paints and brushes, paper, canvas, and films as well as many other materials to make artistic creations; by drawings tracing, painting or coloring. They can also use computers, scanners, copiers and the like to make artistic creations.

"Tracing" is a term commonly used for a procedure involving drawing, by first placing an image under a sheet of transparent or translucent material, and then creating a likeness of the image on the material by using a pencil or other writing instrument to follow the edges or boundaries of the image.

The tracing of two-dimensional objects is a common practice in the field of art Students and professionals often trace images or photographs to create drawings of the originals or to develop new images. This is done manually on paper or film; or electronically with the use of scanners, computers, printers and copiers.

Animated cartoons are developed as a series of drawings. The drawings are created one at a time with the intention of later showing them at a high rate of speed, to create the visual illusion of a drawn object possessing movement. The appearance of movement is achieved by creating an original drawing of an objector character, then a second drawing is made which is essentially the same, but with minor changes in specific elements of the drawing. Each successive drawing is made with the desired elements changing more each time. When viewed at a fast speed, the elements appear to move. For instance, if a cartoon artist wishes to draw a circle with a smiling face and wants to create an animation with the face's smile changing to a frown, he might create the mouth In the first drawing as a horizontal line with the ends curved upward. He would then create the second drawing with all of the elements being identical except for the mouth line, which he would curve upward to a lesser degree. With each successive drawing he would make the line less curved, and eventually he would make it straight. The artist would then begin drawing the face with the line representing the mouth curving downward at the ends and with each successive drawing he would Increase the curves until the mouth appeared to have a frown. Each drawing is made on a sheet of clear film, known in the film Industry as a "cell". This is done for two reasons. First, clear film allows light to pass through, so a special lamp can be used to project the Image onto a wall or projection screen for viewing. Second, clear film allows the artist to make a new drawing by laying a sheet of film over the previous drawing and then precisely "tracing" the elements he wants to remain the same and redrawing the ones he wants to change.

"Cell" art, created by its original artist for the purpose of making animations, can be purchased for display as "still" art and is appealing to children and adults, but is very expensive. An interesting artful endeavor for children and adults would involve creating their own "cell" art. This could be done with the use of clear film and the appropriate marking pens or other drawing Instruments. Another interesting endeavor would involve creating "cell" art of three-dimensional objects which a person possesses; such as a stuffed animal or a toy; or of another person's head and face. This could be done with electronic equipment such as cameras, computers, software and printers; but the cost of buying or renting the equipment would be high, preparation would be tedious and a high level of skill would be needed to operate it.

There is often a desire by those with limited or no artistic skills to make artistic creations which must begin with a drawing of a three-dimensional object; however, creating an accurate visual representation of an object, by drawing it on paper, film, canvas or the like, is a complex task involving highly developed skills and talents which normally require years of training and practice.

Often times an accurate drawing of a three-dimensional object is desired for the purpose of developing art or craft work, or for professional design development. Many times the person requiring the drawing does not possess the skill or talent necessary to create it or he does not have the time to make a drawing with the desired degree of accuracy. Currently, there is no simple device on the market that will assist a person, with little or no drawing skill, in creating an accurate drawing of a three-dimensional object.

The inventor also envisions a new artistic endeavor which involves making real animations of a person's possessions or objects around him with the assistance of a drawing device and peripheral equipment.

Recognizing the need for a new and useful product that will address the foregoing interests, needs, desires, and vision; a new drawing device has been invented by the applicant and will be more fully defined in the following pages.

OBJECTS OF THE INVENTION

In view of the aforementioned artistic activities; and the needs and requirements of those performing or wishing to perform such activities; It is an object of the present Invention to provide a means for creating an accurate drawing of a three-dimensional object.

Another object is to provide a means for a user to draw an object he sees before him.

Sill another object is to provide a means for a user to easily accomplish the complex task of drawing, that normally requires highly developed skills.

It is another object to provide a means by which a person may gain pleasure and satisfaction by using his own hands and eyes to create a drawing.

Yet another object is to assist artists, craftsmen and professionals in making templates and tools for creating refined works.

Still yet another object is to assist a user in saving time when drawing a three-dimension object.

It is another object to assist adults and children in artful endeavors and fun-time activities and hobbies requiring drawing three-dimensional objects.

Another object is to provide the means to create "cell" art.

Still another object is to aid a user in creating cell art of three-dimensional objects.

Yet another object is to provide the means to create "cell" animations of personal possessions.

Still yet another object is to provide a product that is self contained and portable.

A further object is to provide storage areas for drawing supplies.

Yet a further object is to provide a device which can be used with computers, scanners, copiers and other peripheral equipment to make artistic creations.

Other objects and advantages of the present invention will become apparent from the following descriptions, taken In connection with the accompanying drawings, wherein, by way of illustration and example, an embodiment of the present invention is disclosed.

By studying the objectives of the current Invention one can envision many uses for such an invention. Adults and children can use it just for fun to create images of their favorite toys or collectibles, or to draw portraits of their friends and relatives. They can also use it to draw landscapes and "still lifes". They can draw and color directly on the product's window pane with erasable inks and paints. They can also draw and paint on transparent film to create "cell" art, and then remove the art from the invention and give it to others as gifts, or hang it on the wall or refrigerator. Permanent ink and paints can be used to preserve drawings created on film. Also, students can use the invention to complete school art projects. Hobbyists, artists and professionals can use the invention in the course of their practice to make line drawings, paintings, illustrations and artist's renderings. With the appropriate peripheral equipment, one can even make real animations of the objects they see around them.

There is tremendous market potential for a simple device for drawing three-dimensional objects, since the number of individuals with an interest in creating this type of drawing far exceeds the number of people who actually have the talent and skills to do it without assistance.

A Registration System

To understand how the present invention works, it is helpful to know that the inventor embodied a system of "registration" in the device, to hold the user's view point, the object to be drawn and the drawing surface still, so that an accurate drawing can be made. A further explanation follows.

The registration system allowing one unskilled in the art of drawing to immediately and effectively draw pictures of three-dimensional objects, involves establishing a fixed physical relationship between three "elements" involved in an "event" that the inventor describes as "tracing a three-dimensional object". The elements are the artist's eye, the drawing surface and the object to be drawn.

In the art profession, the artist's eye is considered the "view point", the drawing surface is the "picture plane" and the object is called the "subject". An image created of a three dimensional object, that "records" the object from an angle which reveals more than one side is called a "perspective" Image or drawing.

With fixed positioning of the "view point". "picture plane" and "subject", the artist places his drawing instrument tip on the "picture plane" at a point directly between the "view point" and a specific feature of the "subject", i.e. an edge or a boundary, and then while maintaining contact between the instrument tip and the "picture plane", he moves the tip along the edge or boundary, effectively tracing an Image of the "subject" onto the "picture plane". The result is a "perspective" drawing.

If the artist wishes to create a transferable Image, he may do so by first placing a transparent film on the "picture plane" and then drawing directly on the film.

An electronic version of the system may also be constructed whereby the artist draws onto a "sensitive" "picture plane" which transfers the image to a storage and/or display and/or output device, i.e. a computer, monitor, projector or printer.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. Also, It is to be understood that such terms, if used, as "front", "side", "above", and the like are words of convenience and are not to be construed as limiting terms. Referring in more detail to the drawings, the invention will now be described.

Figure 2:
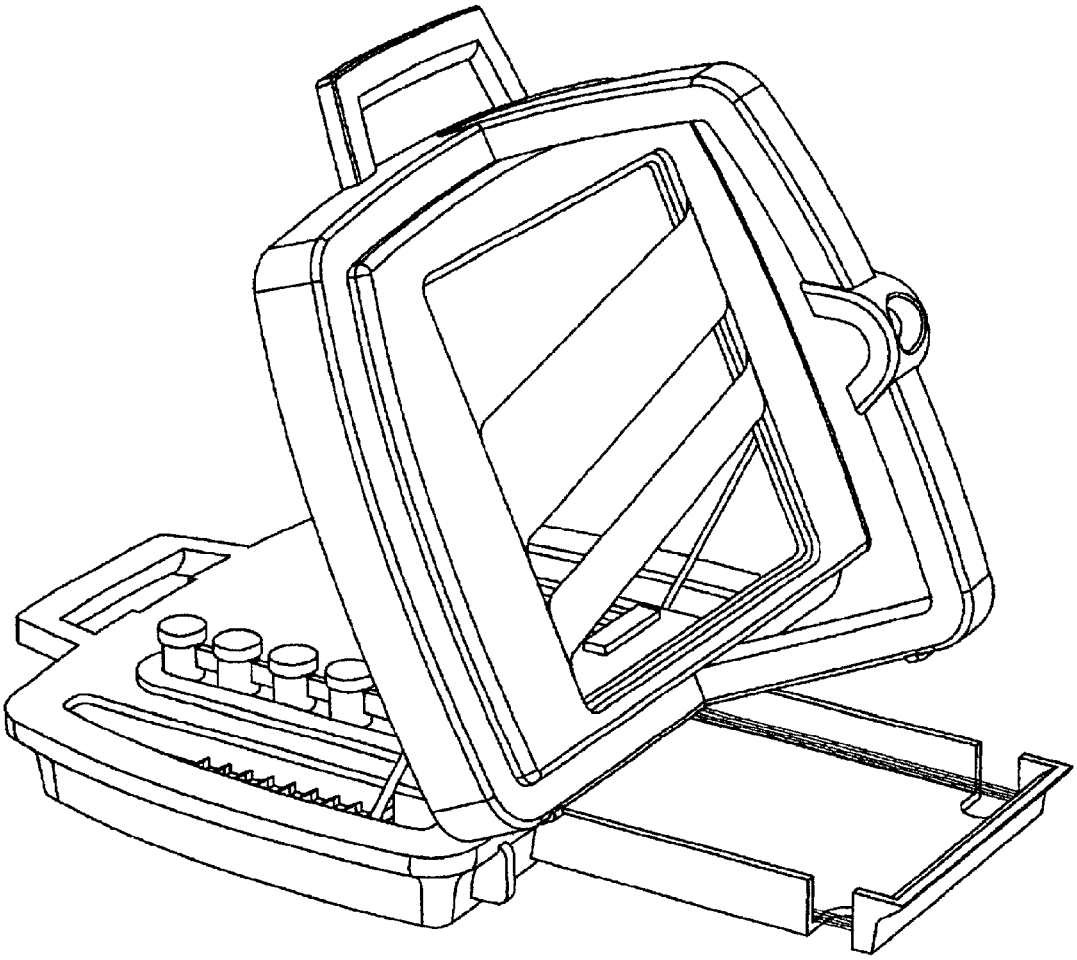
FIG. 2 is a perspective view of the device of the present invention in the open, useable position.
Figure 3:
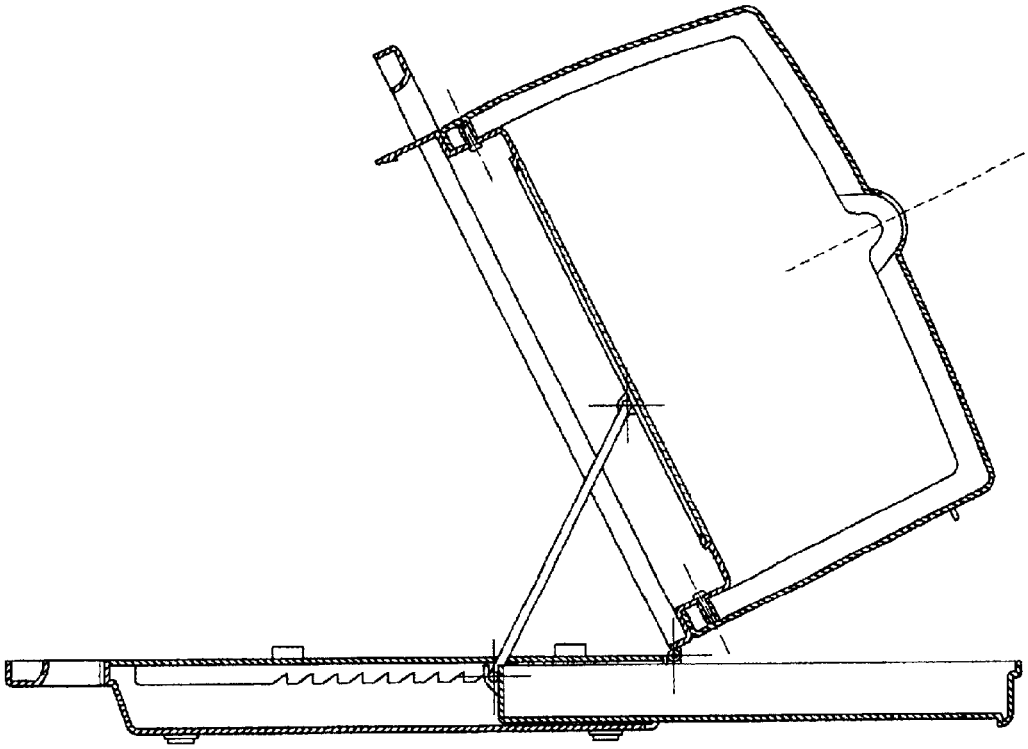
FIG. 3 is a side sectional view of the device of the present invention in the open, useable position.
Figure 4:
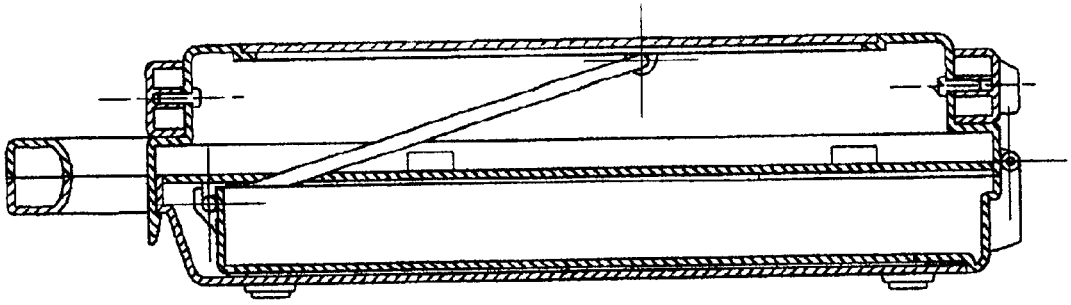
FIG. 4 is a side sectional view of the device of the present invention in the closed position
Figure 5:
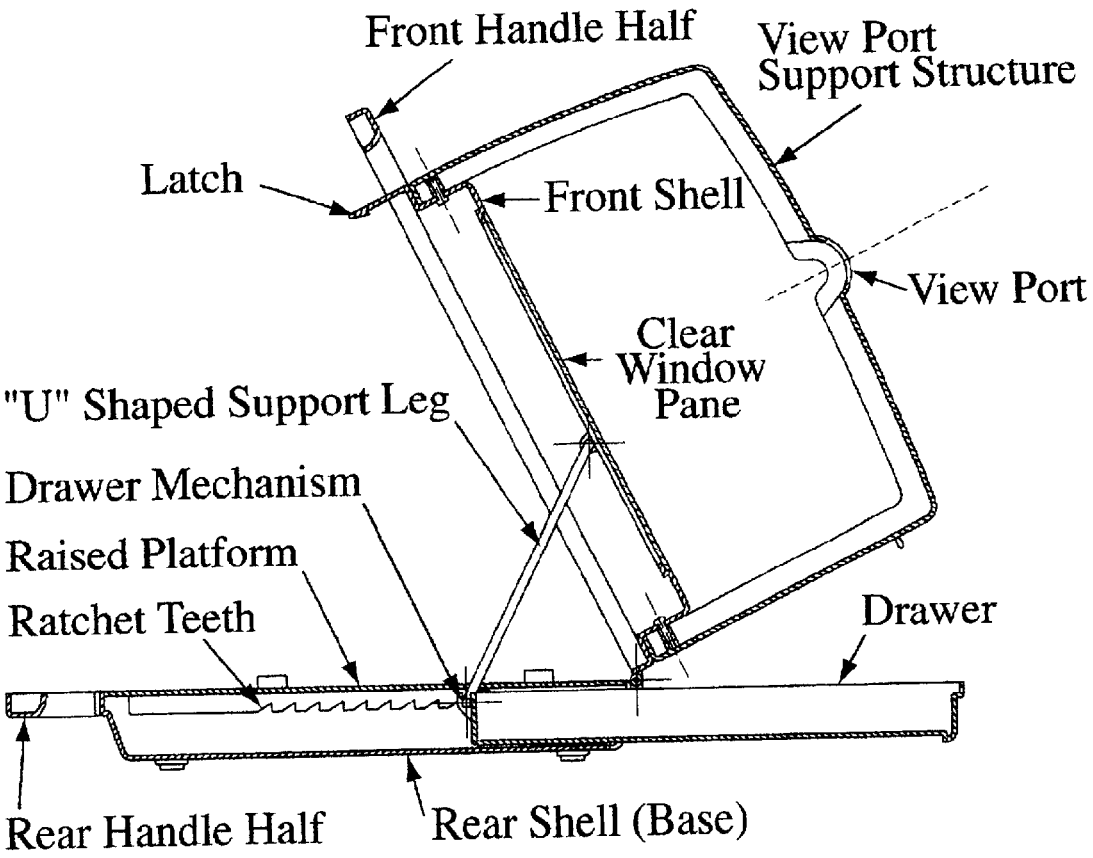
FIG. 5 is a side sectional view of the device of the present invention in the open, useable position with specific parts labeled for ease of reference.
Figure 6:
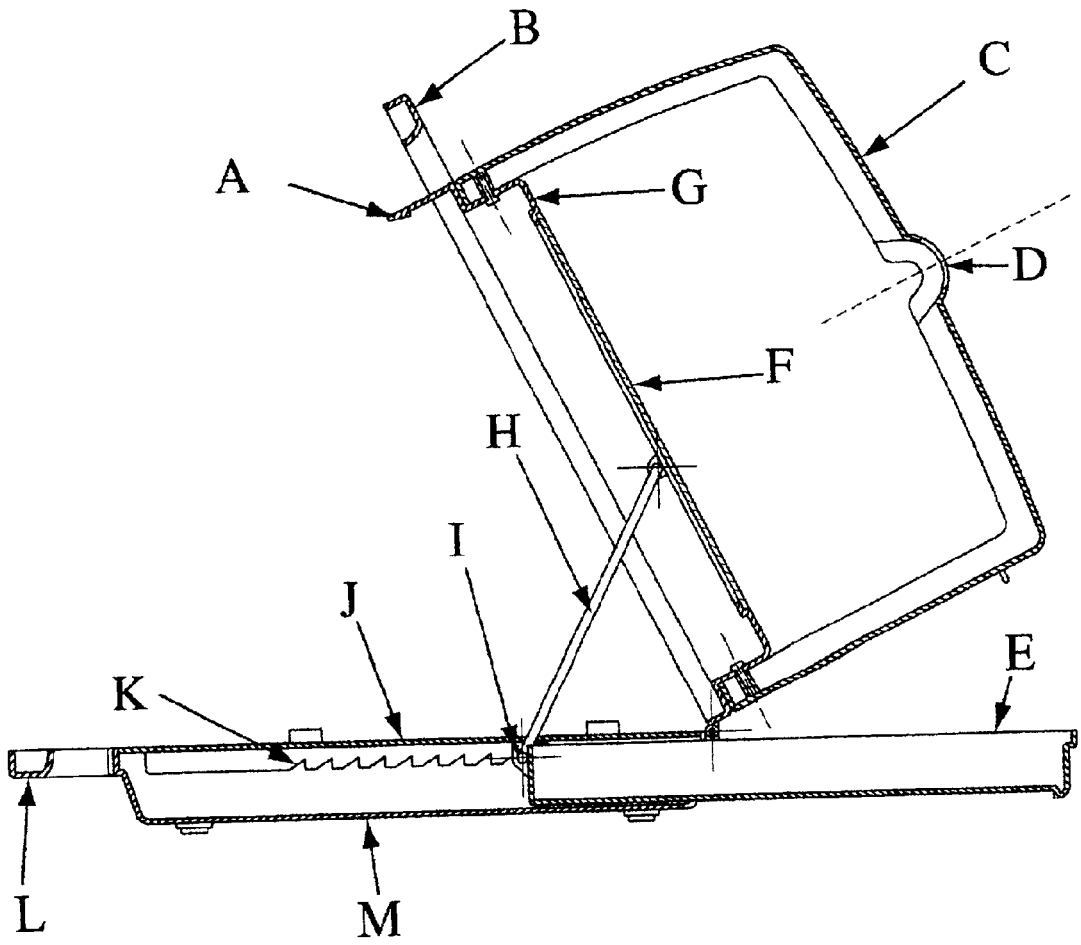
FIG. 6 is side sectional view of the d vice of the present invention in the open, useable position with specific parts referenced.

Referring to FIG. 6, the illustrated embodiment of the reusable drawing device according to the present invention is made up of 13 parts. The device comprises a latch A that keeps the device closed when carrying; the front handle half B that, when in conjunction with the rear handle half L can be used to carry the device; a C-shaped view port support structure C that is positionable and contains a view port D that is used to find and maintain reference points on the object that is being drawn or traced; a drawer E that opens as the device opens and doses when the device closes and is used for supplies; and a clear window pane F that is used to view the object that is placed on a raised platform J. Window pane F is also used for the support of the tracing and or drawing of the object. The front shell or member G of the device when closed, compliments the rear member or shell M; whereby shells G and M fit evenly together comprising inwardly and outwardly the device. A support leg H supports front shell G when in the open position. Leg H is pulled when opening and lifted and pushed when closing to raise or lower all of parts A, B, C, D, F and G, together as one. A drawer mechanism I pivotally connects one end of leg H to the inside end of drawer E. An object is placed on platform F so that it can be viewed through view port D and pane F and traced or drawn on pane F. Ratchet teeth K on a rail in shell half M can engage the inner end of leg H (see FIG. 2) to hold shell half C in any one of several raised positions. Handle half L works in conjunction with handle half B and when combined with B is used for carrying the device in the closed position. The rear shell M of the device as in FIG. 5 is shown as the base.

While the invention has been described in connection with a preferred embodiment and claims have been made thereof, it is not intended to limit the scope of the invention to the particular form set forth, but on the contrary, It is intended to cover such alternatives, modifications, and equivalents as may be included within the spirit and scope of the invention as defined by the appended claims.

OPERATION OF THE INVENTION

The preferred embodiment of the invention may be described as a "lunch box"-like product, also known as a "clamshell"; containing a front shell and a rear shell, which are connected by a hinge at the bottom. There is a latch at the top to keep the shells closed when desirable. The product is useful in two configurations, a closed, carrying configuration and a propped-open, drawing configuration.

The embodiment has a handle, which protrudes from its top and is useful in the carrying configuration. The handle is comprised of two separate halves; a front half and a rear half, each half being integral with its respective shell. When the box is closed and a user grabs the handle, both halves of the handle are captured in the user's surrounding hand, preventing the box from opening. This feature is provided as a safety "Mechanism", in case the box is lifted by the handle when the latch is not secured.

To position the product in the drawing configuration, the user places the box on a table or flat surface, on its rear shell side and with its hinge toward the user. The user then releases the latch, grasps the front handle half and pivots the front shell upward, toward himself—opening the box. The front shell acts as an angled drawing surface and is pivoted upward and forward until the user finds the desired angle for use. The rear shell acts as a base. The inner surface of the front shell has attached a pivoting "U" shaped support leg. The leg pivots at its top end from a point near the center of the front shell and glides at its bottom end, on the top of a wall, projecting from the inner surface of the rear shell. When the box is closed, the support leg lies at an acute angle, relative to the front and rear shell inner surfaces. As the box is opened, the angle of the pivoting support leg, relative to the front shell and rear shell inner surfaces, becomes more obtuse. This occurs as the bottom of the support leg glides in the direction of the hinge. The top surface of the wall, upon which the support leg glides, contains a series of stationary ratchet teeth. The teeth allow the support to glide in the direction of the hinge, unimpeded. The lower end of the gliding leg slides successively up each angled ratchet surface and then drops down its vertical surface. When the user has pivoted the front shell to the desired angle, he lets go of the handle. Gravity then causes the front shell to fall rearward, toward its horizontal closed position. The purpose of the ratchet teeth is to Impede this movement, stopping the lower end of the support leg at the first vertical ratchet surface it reaches. This allows the user to position the front shell at various angles for use.

To close the box, the user pivots the front shell slightly toward himself with one hand, and simultaneously, with the other hand, lifts the lower end of the support leg to an elevation higher than the ratchet teeth. He then holds the support leg at this elevation and pivots the front shell away from himself and into the closed position.

Storage areas are incorporated in the box for holding drawing, coloring and painting materials.

A first storage area is provided as a drawer. The drawer resides in the rear shell and is designed to be opened when the product is in the drawing configuration. The drawer glides along the rear shell's inner surface, opening in the direction of the user, passing under the clamshell hinge. The drawer contains a mechanism that performs two functions. It acts as a lock, preventing the drawer from opening when the box is in the carrying configuration. It also acts as an automatic drawer opening and closing device. The mechanism comprises a hinge sleeve, located on the outer surface of the drawer's rearwall. The hinge sleeve captures the base of the "U" shaped support leg, fixing it rotatably to the rear of the drawer. This mechanism provides linkage of the drawer and front shell, causing the drawer to move in concert with the front shell. As the user opens the box into the drawing conflagration, the drawer automatically glides open. As the user closes the box, the drawer automatically closes. With a physical link to the front shell, the drawer cannot open accidentally while the box is in the closed position.

A second storage area is provided within the box proper. Storage occurs primarily in the rear shell and is accessible when the box is in the drawing configuration. A raised platform in the rear shell provides a cover for the drawer, preventing contents of the two storage areas from mixing. The second storage area contains clips and pockets; which organize and hold the materials in a fixed position when stored and transported.

The raised platform also covers the base of the support leg, preventing it from disturbing stored materials as it glides forward and back.

The front shell contains a dear window pane, which has two purposes. Its primary purpose is for drawing and tracing, and is also called a "picture plane". Its secondary purpose is for displaying the users art work; providing a portable picture frame.

Figure 1:
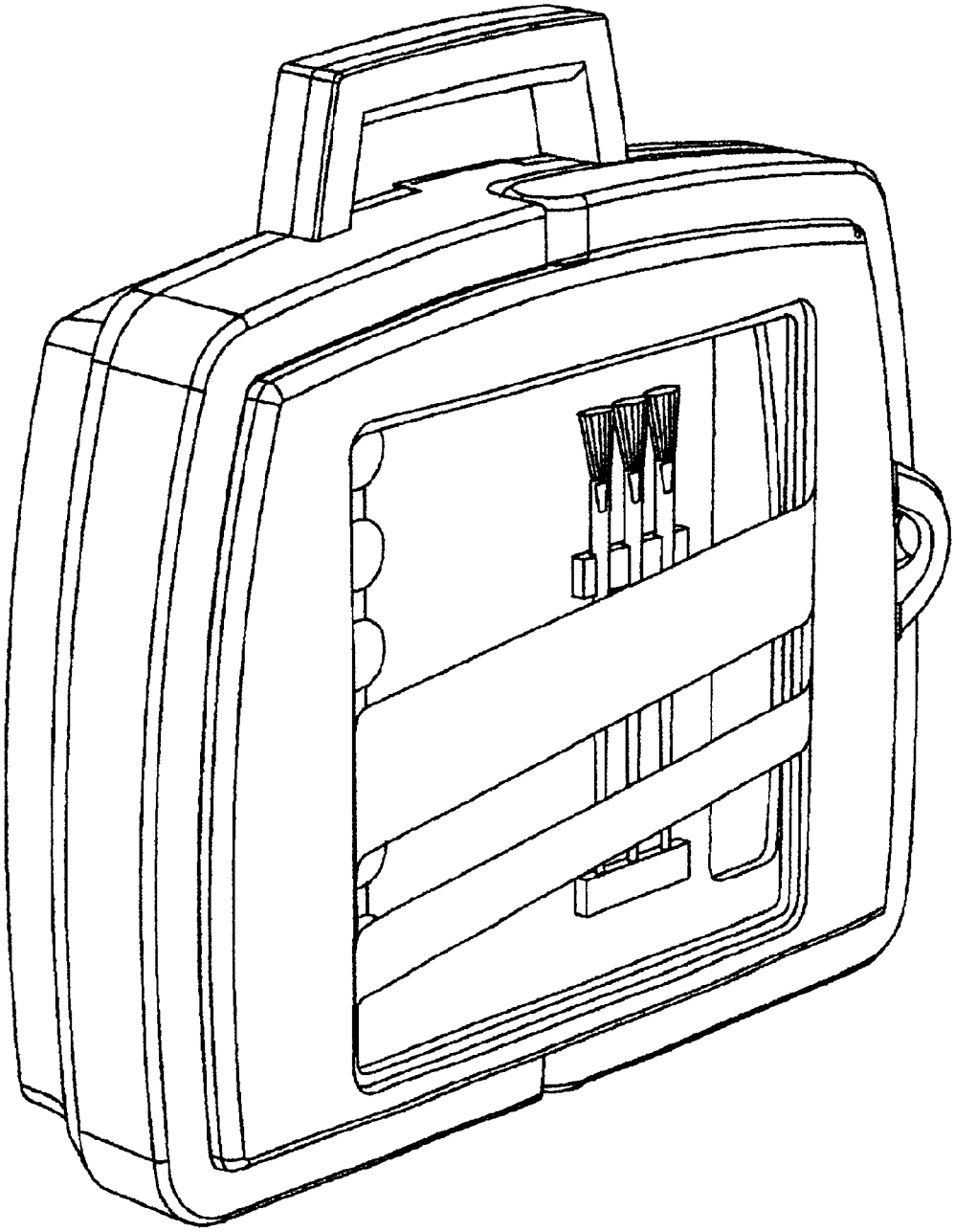
FIG. 1 is a perspective view of the device according to the present invention in the closed, carrying position, standing upright.

The product has a view port; which is instrumental in its use. The view port is an "eye piece" component that consists of a contoured block with a hole through it. The block is attached to the C-shaped support structure C, which pivots from the outer rim of the front shell as shown in FIG. 1, to a viewing position shown in FIG. 2 with the viewport D spaced in front of window pane F so as to view the object on platform J through the window pane. The pivoting function allows the view port to store neatly at the rim of the front shell for transport and to swing out for use. In the use position, the view port provides the user with a fixed point, also called a "view point", through which to view an object to be drawn. The object is positioned on the raised platform which is located near the surface of the window pane opposite the "view point". By looking through the hole in the view port, the user keeps his eye in a fixed position relative to the object and the picture plane as he makes his drawing.

An important feature of the invention is its containment of the components necessary to "fix" the relationship between the three "elements" involved in the "event" regarded as "tracing a three-dimensional object"—the elements being, the "subject", the "picture plane" and the "view point".

The clamshell device herein described is an example of a product that conveniently contains, in a non detachable arrangement, the means to "fix" all three "elements". The clamshell device has a platform component for holding the "subject", which is attached to the rear shell component. It contains a window pane component for holding the drawing in the "picture plane" position, which is contained in the front shell component. It also contains a fold-out view port component which supplies a "view point" through which to view the "subject", which is attached to the front shell component. Together, the components for "fixing" the "subject", "picture plane" and "view point" "elements" are contained and used in a single unified device.

The preferred embodiment contains a view port support arm that stores near the perimeter of the product's front shell and pivots directly into the use position. Alternately, the view port and its support arm could be designed to permit extension of the "view point" to a position further away from the "picture plane" allowing varied relationships between the three elements.

The preferred embodiment can be used to "trace" an object too large or inappropriate for placement within the confines of the clamshell device. This is done by opening the front shell to its near vertical position and placing the device on a stationary object between the user and a stationary "subject". An example of such a use would involve the user setting the product on a table top and "tracing" a person sitting at the table across from him. The device could also contain a provision for mounting it to a stand or tripod, allowing the user to position it at a comfortable working height without relying on a table top or flat surface for support. Alternately, an embodiment could be designed where the clamshell halves open beyond 90 degrees, the rear shell being configured to serve as a table top stand for the front shell. An additional leg would be added to the rear shell to make the configuration stable.

Another embodiment of the device could contain components that are detachable, allowing the user to construct a system where components are disconnected but remain useful in "fixing" the elements necessary for "tracing" a three-dimensional object. An example of such an embodiment would be a product with a removable view port that could be attached to a stationary object such as a stand or tripod, allowing the user to further adjust the distance between the "view point" and the "picture plane" to achieve different relationships between the "elements", A further example of such an embodiment would be a product with detachable front and rear shells, allowing the user to remove the rear shell for more practical placement and use of the front shell. Such a product would be useful for attachment to the window of a house by suction, allowing the user to stand or sit inside the house and "trace" a "subject" situated outside the house. The "subject" may be a vehicle, a tree, a landscape, a toy or other stationary objects.

The storage areas and components that comprise them, as described in the preferred embodiment, are useful in containing and transporting drawing, coloring and painting materials, however embodiments could be envisioned where one or both of these areas are eliminated or reconfigured. Additional storage areas could also be included.

One could also envision an alternate embodiment where the rear shell serves only as a base, having no storage capacity, or an embodiment where the rear shell is eliminated. Such embodiments would still provide the user with the components necessary to create a "tracing" of a three-dimensional object. Examples would include the aforementioned alternate embodiments capable of mounting to a stand or attaching to a window.

Additionally an embodiment could contain connectors, or a transmitter and/or receiver component, for communicating with a computer or other equipment; allowing the user to create electronic art.

The preferred embodiment uses a monocular viewing system as a view port, requiring the user to close one eye, while viewing the "subject" through the view port with the other, in order to create a single line of sight between the "subject" and the "view point". Alternately, a binocular viewing system could be incorporated in the design, allowing the user to view the object with both eyes, their separate views being converged by the system to create a single sight line.

What is claimed is:

1. A tracing device for tracing an object, comprising:

a rear member in the form of a rear shell and defining a platform for supporting an object to be traced;

a front member pivotally mounted to the rear member and having a clear window pane defining a tracing plane, through which the platform, and an object supported on the platform are visible;

positioning means connected between the rear member and the front member for supporting the front member in at least one open position with respect to the rear member for defining an enlarged object space between the platform and the window pane, the positioning means comprising a support leg;

a support structure movably mounted to the front member for movement between a stored position and a viewing position;

means defining a view port at a location on the support structure for viewing the platform and an object on the platform, through the view port when the support structure is in the viewing position so that an image of the object on the platform can be traced at the tracing plane of the window pane; and a drawer slidably mounted into and out of the rear shell, the support leg being pivotally mounted to the drawer so that the drawer slides out of the rear shell when the front member raises to the open position.

2. A tracing device according to claim 1, wherein the positioning means includes means for supporting the front member at a plurality of different angles to the rear member, each forming a different open position for defining a different enlarged object space.

3. A tracing device according to claim 2, wherein the positioning means comprises the support leg pivotally connected to one of the front and rear members and engagable with one tooth of a ratchet rail connected to the other of the front and rear members for supporting the front member in the open position with respect to the rear member.

4. A tracing device according to claim 3, wherein the support leg is U-shaped.

5. A tracing device according to claim 1, wherein the front member is a front shell for carrying the clear window pane.

6. A tracing device according to claim 5, including a latch connected to at least one of the front and rear shells for latching the shells together when the shells are pivoted together into a closed position with the window pane above the platform.

7. A tracing device according to claim 6, including a handle connected to at least one of the shells for carrying of the device when the shells are in the closed position.

8. A tracing device for tracing an object, comprising:

a rear member defining a platform for supporting an object to be traced;

a front member pivotally mounted to the rear member and having a clear window pane defining a tracing plane, through which the platform, and an object supported on the platform are visible;

positioning means connected between the rear member and the front member for supporting the front member in at least one open position with respect to the rear member for defining an enlarged object space between the platform and the window pane;

a support structure movably mounted to the front member for movement between a stored position and a viewing position; and means defining a view port at a location on the support structure for viewing the platform and an object on the platform, through the view port when the support structure is in the viewing position so that an image of the object on the platform can be traced at the tracing plane of the window pane, the support structure comprising a C-shaped support pivotally mounted to the front member for movement between the stored position where the C-shaped support engages around part of a perimeter of the front member, and the viewing position where the C-shaped support is in front of the front member.

9. A tracing device according to claim 8, wherein the front member is pivotally connected to the rear member and the positioning means includes means for supporting the front member at a plurality of different angles to the rear member, each forming a different open position for defining a different enlarged object space.

10. A tracing device according to claim 9, wherein the positioning means comprises a support leg pivotally connected to one of the front and rear members and engagable with one tooth of a ratchet rail connected to the other of the front and rear members for supporting the front member in the open position with respect to the rear member.

11. A tracing device according to claim 10, wherein the support leg is U-shaped.

12. A tracing device according to claim 11, wherein the rear member is a rear shell, the device including a drawer slidably mounted into and out of the rear shelf, the support leg being pivotally mounted to the drawer so that the drawer slides out of the rear shell when the front member raises to the open position.

13. A tracing device according to claim 12, wherein the front member is a front shell for carrying the clear window pane.

14. A tracing device according to claim 13, including a latch connected to at least one of the front and rear shells for latching the shells together when the shells are pivoted together into a closed position with the window pane above the platform.

15. A tracing device according to claim 14, including a handle connected to at least one of the shells for carrying of the device when the shells are in the closed position.

* * * * *